US009635456B2

(12) United States Patent
Fenichel

(10) Patent No.: US 9,635,456 B2
(45) Date of Patent: Apr. 25, 2017

(54) DIGITAL SIGNAL PROCESSING WITH ACOUSTIC ARRAYS

(71) Applicant: Neil Fenichel, Bellevue, WA (US)

(72) Inventor: Neil Fenichel, Bellevue, WA (US)

(73) Assignee: Signal Interface Group LLC, Bellevue, WA (US)

( * ) Notice: Subject to any disclaimer, the term of this patent is extended or adjusted under 35 U.S.C. 154(b) by 128 days.

(21) Appl. No.: 14/521,416

(22) Filed: Oct. 22, 2014

(65) Prior Publication Data

US 2015/0117673 A1 Apr. 30, 2015

Related U.S. Application Data

(60) Provisional application No. 61/896,407, filed on Oct. 28, 2013.

(51) Int. Cl.
*H04R 3/00* (2006.01)
*H04R 19/04* (2006.01)

(52) U.S. Cl.
CPC ..... *H04R 3/005* (2013.01); *H04R 19/04* (2013.01); *H04R 2201/003* (2013.01)

(58) Field of Classification Search
CPC ... H04R 19/04; H04R 2201/003; H04R 3/005
USPC ..... 381/58, 91, 92, 110, 111, 122; 700/94
See application file for complete search history.

(56) References Cited

U.S. PATENT DOCUMENTS 8,619,821 B2 12/2013 Pan et al.
2009/0299742 A1* 12/2009 Toman ..... G10L 21/0272 704/233
2010/0202628 A1* 8/2010 Meyer ..... H04R 1/406 381/92
2011/0110195 A1* 5/2011 Hall ..... F41J 5/06 367/118
2013/0034241 A1* 2/2013 Pandey ..... H04M 9/082 381/92
2014/0241548 A1* 8/2014 Kim ..... H04R 1/083 381/91
2014/0270260 A1* 9/2014 Goertz ..... G10L 25/84 381/110

OTHER PUBLICATIONS

Lewis, Jerad, "Microphone Array Beamforming," Analog Devices, AN-1140, Application Note, 2012, 8 pages.

* cited by examiner

*Primary Examiner* — Paul S Kim
(74) *Attorney, Agent, or Firm* — Ellen M. Bierman; Lowe Graham Jones PLLC

(57) ABSTRACT

Methods, systems, and techniques of digital signal processing using acoustic arrays are provided. Example embodiments described herein provide enhanced acoustic arrays that utilize MEMS digital microphones to offer greater control and measurement capabilities to users and systems that desire to measure sound typically to derive other data. Large numbers of digital microphones can be manufactured to be placed on an acoustic array to derive a plurality of derived acoustic array measurements.

20 Claims, 6 Drawing Sheets

DIGITAL SIGNAL PROCESSING WITH ACOUSTIC ARRAYS

TECHNICAL FIELD

The present disclosure relates to methods, techniques, and systems for the use of acoustic arrays, particularly acoustic arrays that include micro-electronic mechanical systems (MEMS) technology microphones.

BACKGROUND

An acoustic array is a sensor for measuring sound pressure levels simultaneously from a set of points in space. An acoustic array typically includes a set of microphones arranged on a rigid structure such as a frame or a flat plate, along with electronic circuits for converting the sound pressure level measurements to digital form, and then transferring the digitized signals to a computer. Signals from an acoustic array can be processed with various digital signal processing algorithms. Acoustic arrays sometimes are used for locating sounds from machines, for example from automobiles or from turbines for power generation.

One problem with current acoustic arrays is that they are too expensive and too complex for many applications, either because they use expensive components such as analog microphones that require amplifiers and filters or because they use digital microphones that require complex decoder circuits or logic for every microphone. Another problem with current acoustic arrays is that they consume too much power not lending themselves to all applications.

DETAILED DESCRIPTION

Embodiments described herein provide enhanced acoustic arrays that utilize MEMS digital microphones to offer greater control and measurement capabilities to users and systems that desire to measure sound typically to derive other data.

Electronic Technology in Signal Interface Group Acoustic Arrays

Acoustic arrays from Signal Interface Group (SIG), SIG acoustic arrays, consist of large numbers of digital (e.g., MEMS) microphones, typically 32, 64, 80, or more, that are sampled simultaneously to provide synchronized measurements.

Figure 1:
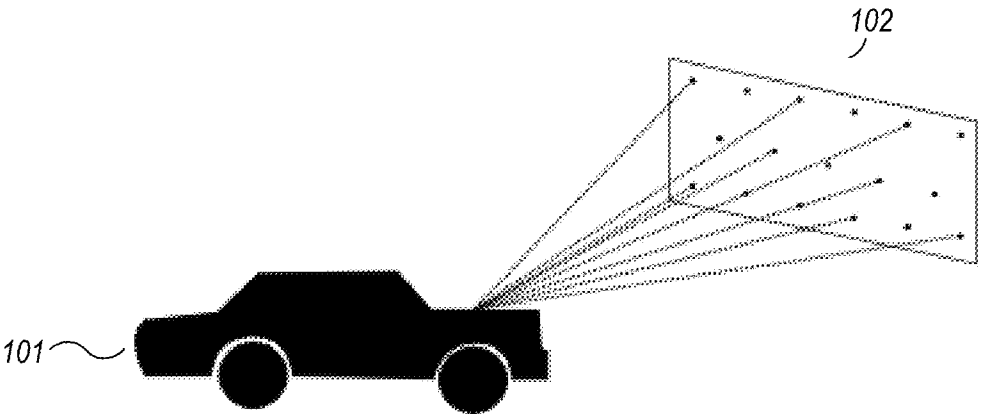
FIG. 1 is a block diagram of an example use of a SIG acoustic array.

The diagram in FIG. 1 shows a car (101) as a typical sound source and a microphone array (102), the rectangle in the top right corner, digitizing the sound from the car. As the diagram suggests, the microphones in the array are at slightly different distances from any location on the car.

Sound from the car arrives at each microphone at a slightly different time and with a slightly different amplitude. While these differences are small, with precise measurements and sophisticated algorithms the SIG acoustic arrays yield useful information about the locations of sound sources within the car, which can then be used for other measurements if desirable.

Sound is digitized—converted to numbers—in the microphones of the SIG acoustic array. The microphones measure sound pressure level (raw acoustic array measurements). Digital signal processing algorithms then are applied to the raw acoustic array measurements to produce useful calculated values (derived acoustic array measurements).

The digital signal processing algorithms applied to the measurements from SIG acoustic arrays may be executed in special purpose devices such as field programmable gate arrays (FPGAs) or systems-on-chip (SOCs), or they may be executed in computing systems such as personal computers or servers, physical or virtual, or they may be executed in part in special purpose devices and in part in general purpose computers, or they may be embedded in other components. (See, for example, the block diagram of a computer system programmed with instructions to execute the digital signal processing algorithms illustrated in FIG. 4.) The raw acoustic array measurements may be stored either temporarily or permanently in the special purpose devices or in the general or special purpose computing systems. The SIG processing system provides some of the digital signal processing algorithms and provides tools for users to customize the algorithms. The SIG processing system uses open data formats to allow users to develop new algorithms.

With a single microphone it is possible to observe the sound from a car as it passes, but not to locate the sources of the sound. With a SIG acoustic array it also is possible to locate the sources of the sound. The accuracy of the location detection and processing depends the positions of the microphones, the quality of the microphones, the quality and size of the acoustic array, and the choice of signal processing algorithms.

Figure 5:
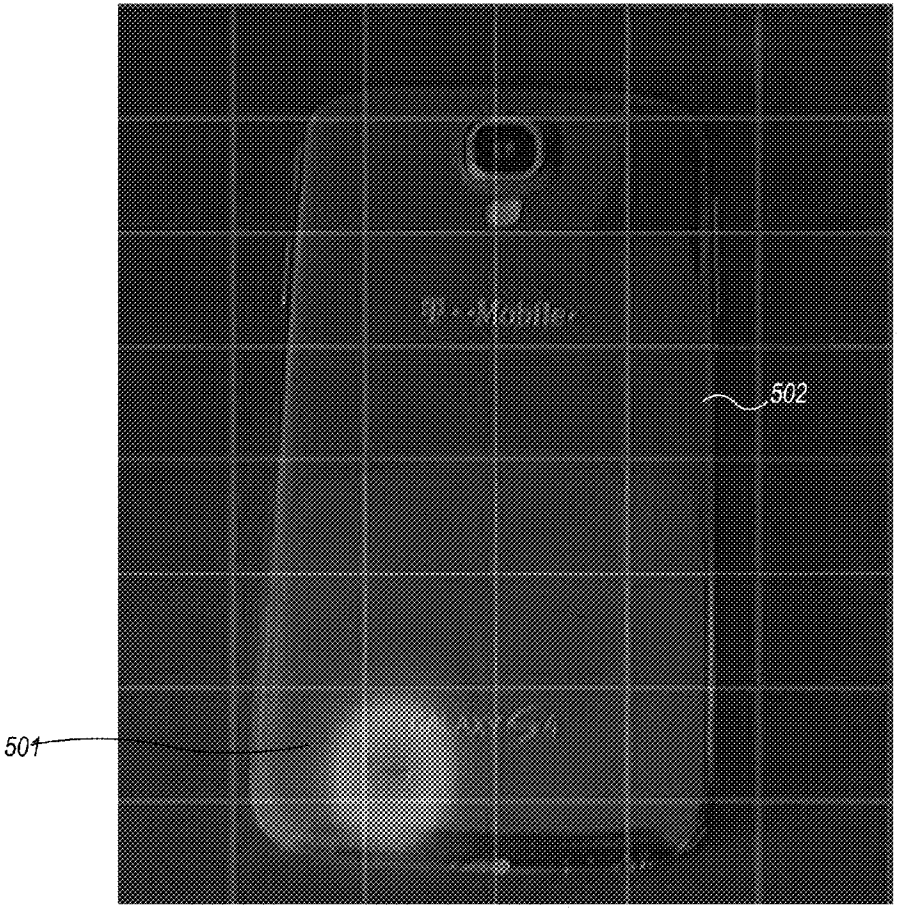
FIG. 5 illustrates use of a beamforming algorithm to produce an image of sound pressure on an optical image.

SIG acoustic arrays provide the measurements required to locate sound sources based on small differences. Two major uses for SIG acoustic arrays are:

1. To estimate the intensity of the sound coming to an acoustic array from different directions. In this case the derived acoustic array measurements are the estimated sound pressure levels from a large number of directions. In many applications the sound pressure levels are represented as images and superimposed on optical camera images. One of the digital signal processing algorithms used in this application is frequency domain beamforming. FIG. 5 illustrates the use of a beamforming algorithm (logic) to produce an image of sound pressure on an optical image. Here, the image of the sound pressure 501 is a "hotspot" which is superimposed on an image of a cellphone 502. This technique may be useful, for example, in measuring vibrations of an automobile with accelerometers and strain gauges while concurrently locating sound sources.

2. To reconstruct the sound coming to an acoustic array from different locations, using digital signal processing to focus the sound from a specified source. Delay and sum is one digital signal processing algorithm that is applied to this application. The measurements from the different microphones are delayed and added so that the signals from one direction add constructively and the signals from other directions interfere and result in lower intensities. For example, this technique may be useful in recording sound for a movie production and later processing the sound while editing the movie.

MEMS Microphones in Signal Interface Group Acoustic Arrays

Figure 2:
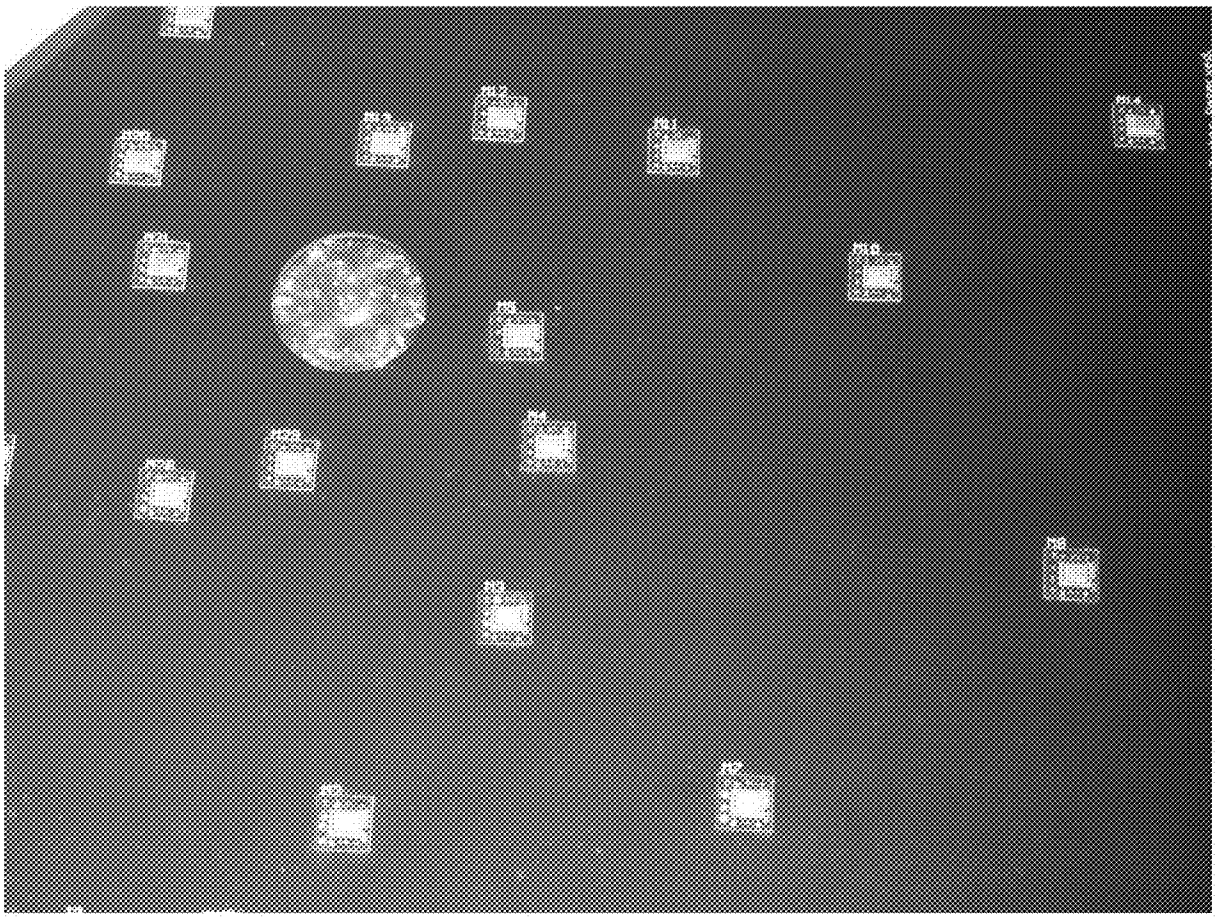
FIG. 2 is a photograph of example microphones used in a SIG acoustic array.

New microphones have been introduced using microelectronic mechanical systems (MEMS) technology. These microphones provide a digitized measurement without requiring preamplifiers, amplifiers, or analog to digital converters. One type of MEMS microphone provides 24-bit digitized measurements in a serial format that can be connected directly to FPGAs or SOCs. FIG. 2 is a photograph of the example microphones used in a SIG acoustic array. MEMS digital microphones may use standard protocols such as I2S or SPI to transmit acoustic data.

Acoustic array hardware from SIG combine MEMS microphones with FPGAs or SOCs. The resulting raw acoustic array measurements optionally can be processed in the FPGAs or SOCs. Then the raw acoustic array measurements or the derived acoustic array measurements can be transported to general or special purpose computers or other devices for processing, display, and storage (as demonstrated in FIG. 4). This combination of technologies reduces the number of components in an acoustic array, reducing cost, size, complexity, and power consumption while making the physical structure of the array more robust.

Using MEMS microphones substantially reduces the cost per microphone in an acoustic array. The cost is low enough to make it practical to build arrays with 64 or more microphones and then to select subsets of the microphones as required by different applications or at different frequencies in one application. With previous technology arrays of 64 or more microphones are very expensive.

The frequencies of interest in acoustics are within the range from 20 Hz to 20 KHz. The smaller range from 60 Hz to 15 KHz covers most sounds of interest. (Sound above 20 KHz is important, but it generally is considered to be ultrasound.) The speed of sound is approximately 340 meters per second. The wavelength at a given frequency is the speed of sound divided by the frequency, so the wavelengths of interest typically range from 1.7 meters at 20 Hz to 1.7 millimeters at 20 KHz.

Because of the wavelength differences just cited, at low frequencies it typically is best to have microphones that are spread over a large area, while at high frequencies it typically is best to have microphones that are close together. One advantage of the SIG acoustic array technology is that the low cost of the microphones makes it practical to build acoustic arrays with a large number of microphones. With extra microphones it is possible to select subsets of microphones for use in digital signal processing at different frequencies.

Data Blocks for Digital Signal Processing in Signal Interface Group Acoustic Arrays Digital signal processing in low-cost acoustic arrays presents a number of challenges. Digital signal processing algorithms such as Fast Fourier Transform (FFT) act on data blocks from individual microphones. An acoustic array generally acquires data from all microphones at one time, so before applying digital signal processing algorithms such as FFT, the acquired data must be arranged into data blocks as acquired from individual microphones.

The technology for creating logic in an FPGA or an SOC to calculate FFTs on data blocks from one microphone is known. This technology is available, for example, from Xilinx, a manufacturer of FPGAs and SOCs, in the Fast Fourier Transform generator included in the Xilinx ISE Design Suite. Because of limitations in the logic in an FPGA or an SOC, the existing technology is not directly applicable to calculating FFTs on large numbers of microphones.

It is possible to arrange the data from all of the microphones in an acoustic array into data blocks from individual microphones by writing the data into a random access memory in one order and then reading the data out of the random access memory in another order. One implementation of arranging the data into data blocks from individual microphones uses internal random access memories in FPGAs or SOCs. FPGAs and SOCs that are suitable for use in acoustic arrays contain internal random access memories, but the internal random access memories are too small for arranging the data into data blocks from individual microphones. Another implementation of arranging the data into data blocks from individual microphones uses dynamic random access memory (DRAM) integrated circuits external to an FPGA or an SOC. This is inefficient because DRAMs are block-oriented devices, and the implementation of arranging the data in DRAMs incurs a large penalty in speed and code complexity.

Figure 6:
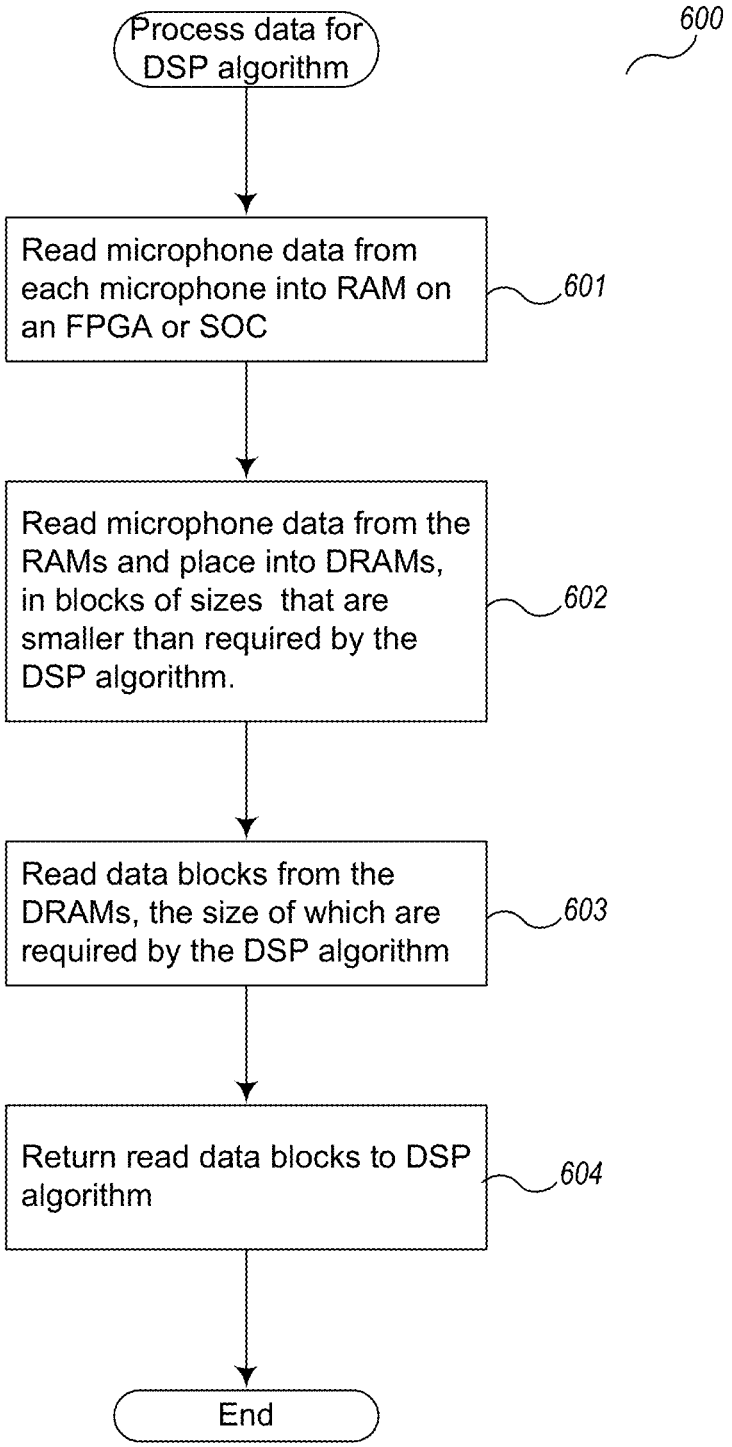
FIG. 6 illustrates an example flow diagram for an implementation of arranging microphone data for processing by digital signal processing algorithms.

FIG. 6 illustrates an example flow diagram for an implementation of arranging microphone data for processing by digital signal processing algorithms. A new implementation of arranging the microphone data into data blocks from individual microphones arranges the microphone data first into small blocks and then into larger blocks, the size of which are defined as required for digital signal processing algorithms (DSPs) such as FFT. Specifically, the microphone data are written first to a small internal random access memory in an FPGA or an SOC (601), and then are read out (retrieved) from that internal random access memory in blocks that are smaller than the data blocks required for the digital signal processing algorithms such as FFT (602). The retrieved small blocks are written to a DRAM (602), such as a DRAM external to the FPGA or SOC, and then are read out from the DRAM in blocks of the size required by the particular digital signal processing algorithm being used (603). The blocks are returned to the DSP for use as needed (604). This implementation does not incur a significant penalty in speed and code complexity.

Manufacturing Technology in Signal Interface Group Acoustic Arrays

Manufacturing low-cost acoustic arrays presents a number of challenges. With inexpensive microphones the cost of wiring to connect the microphones may be higher than the cost of the microphones.

Figure 3:
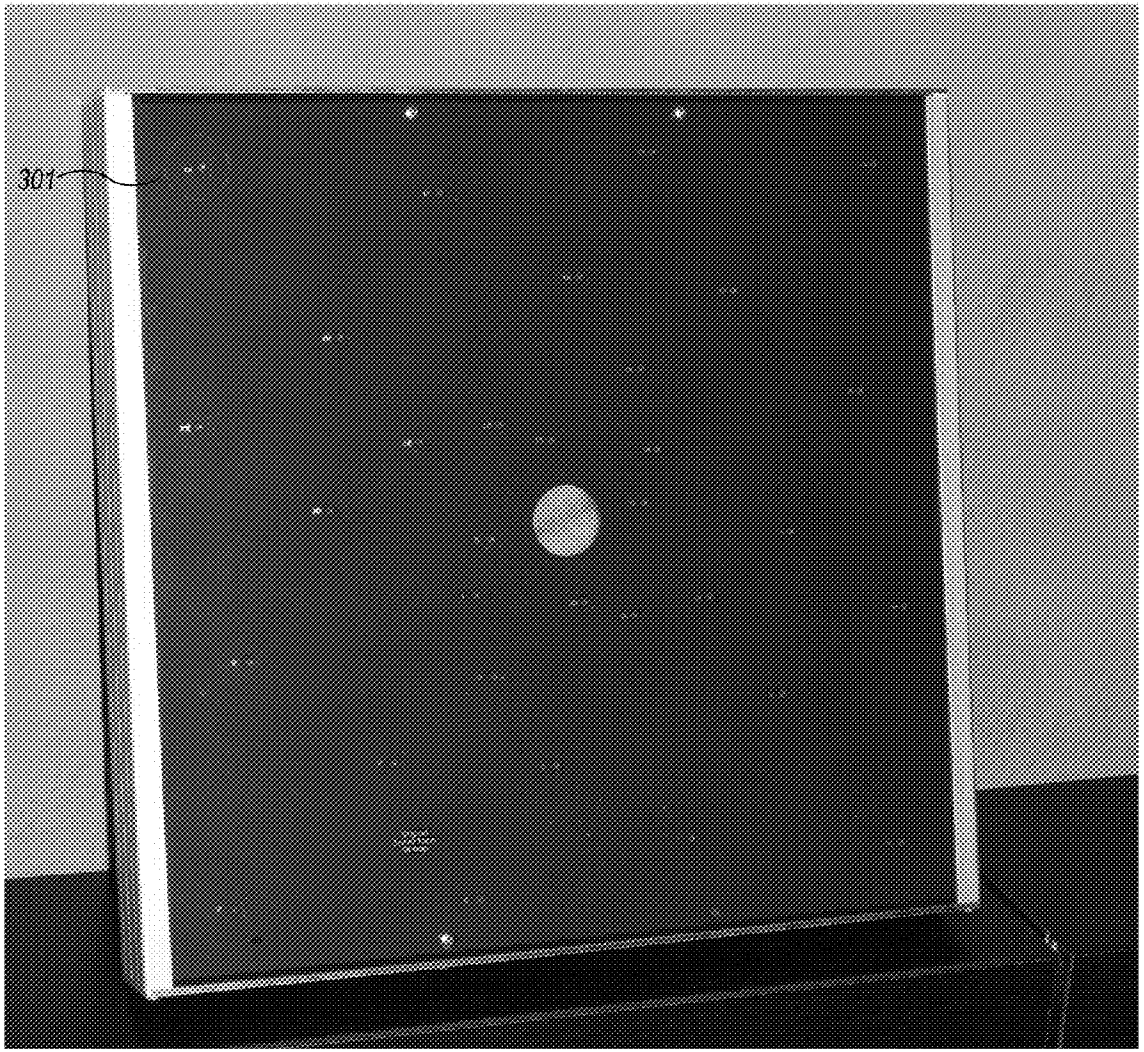
FIG. 3 is a photograph of an example SIG acoustic array.

The required size of SIG acoustic arrays is determined by the wavelength of sound at the frequencies of interest, so the arrays have to be large, typically at least 30 cm×30 cm. FIG. 3 is a photograph of an example SIG acoustic array. The illustrated array is 30 cm×30 cm. Circle 301 designates one of the plurality of microphones attached (soldered, mounted or otherwise affixed) to the acoustic array. The microphones appear as white rectangles on the small green printed circuit boards shown in FIG. 2. The microphones are located on the back side of the array. Sound reaches the array through small openings in the array as seen in FIG. 3. One embodiment is currently targeted at 40 cm×40 cm with 40 microphones, and another embodiment is 60 cm×60 cm with 80 microphones, although embodiments with less or more microphones are contemplated. To reduce the cost of wiring, SIG determined that it is best to mount the microphones on one or several large printed circuit boards. These printed circuit boards are too large to be soldered economically by machine. The microphones cannot easily be soldered by hand, so SIG found that the best technique is to have the microphones soldered by machine to very small, thin, printed circuit boards, and then to solder those circuit boards to large printed circuit boards by hand. This also reduces the cost of rework in case it is necessary to remove and replace any of the microphones. This technology reduces costs by eliminating almost all wires. In prior acoustic arrays the microphones typically are connected with wires, adding labor and material costs.

Another manufacturing issue is that the large printed circuit boards tend to resonate at some of the frequencies of interest for acoustic arrays. SIG found that it is advantageous to make the large circuit boards very thin and then to attach them firmly to large, rigid, plates.

Example Computer System

Figure 4:
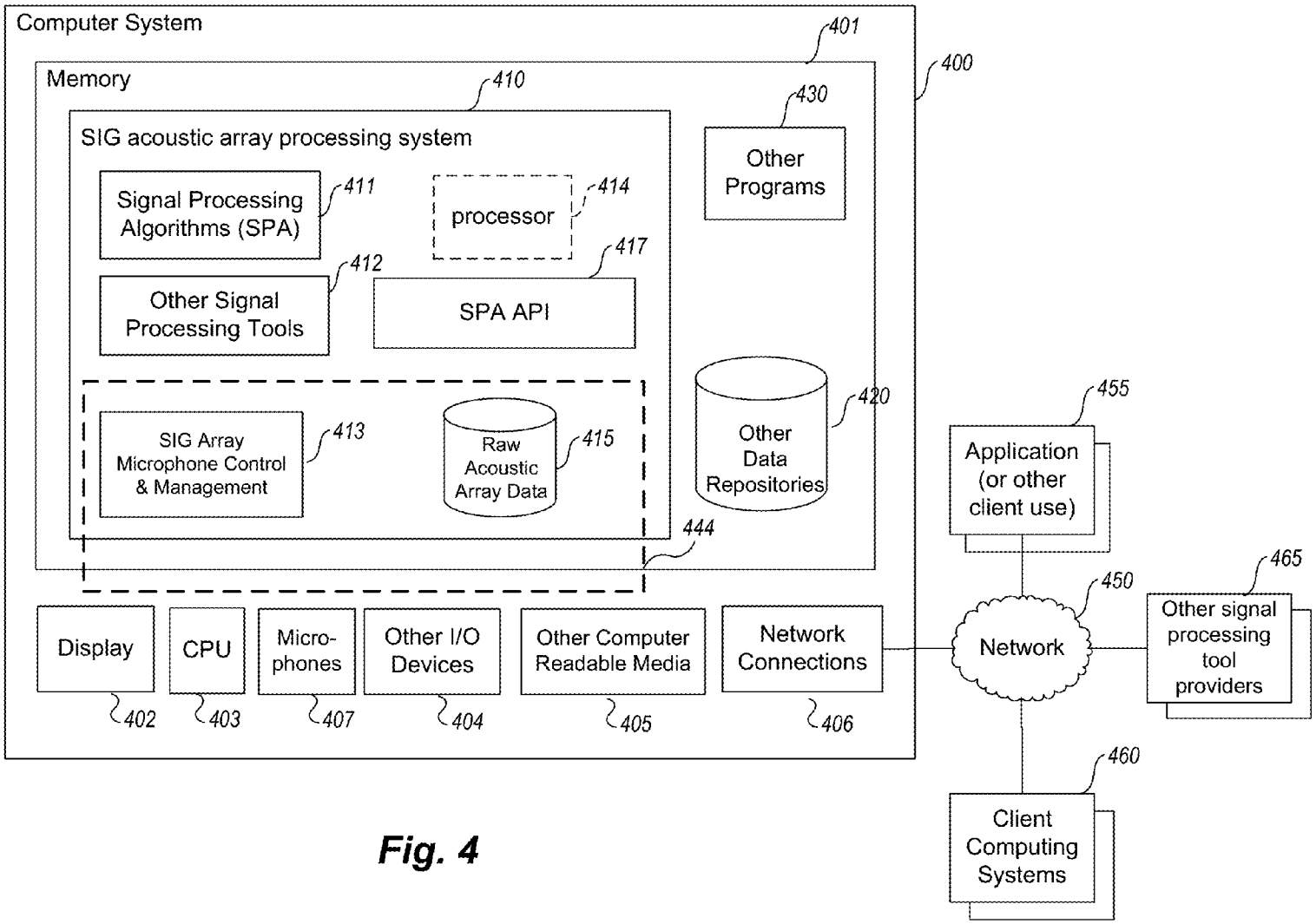
FIG. 4 is an example block diagram of a computing system for practicing signal processing embodiments used with a SIG acoustic array.

FIG. 4 is an example block diagram of an example computing system that may be used to practice embodiments of the SIG acoustic array technology described herein. Note that one or more virtual or physical computing systems suitably instructed may be used to implement the signal processing. Further, the signal processing and microphone management may be implemented in software, hardware, firmware, or in some combination to achieve the capabilities described herein.

The computing system 400 may comprise one or more server and/or client computing systems and may span distributed locations. In addition, each block shown may represent one or more such blocks as appropriate to a specific embodiment or may be combined with other blocks. Moreover, the various blocks of the SIG acoustic array processing system (SAAPS) 410 may physically reside on one or more machines, which use standard (e.g., TCP/IP) or proprietary interprocess communication mechanisms to communicate with each other.

In the embodiment shown, computer system 400 comprises a computer memory ("memory") 401, a display 402, one or more Central Processing Units ("CPU") 403, one or more microphones (e.g., digital microphones) 407, other Input/Output devices 404 (e.g., keyboard, mouse, CRT or LCD display, etc.), other computer-readable media 405, and one or more network connections 406. The SAAPS 410 is shown residing in memory 401. In other embodiments, some portion of the contents, some of, or all of the components of the SAAPS 410 may be stored on and/or transmitted over the other computer-readable media 405. The components of the SAAPS 410 preferably execute on one or more CPUs 403 and manage the set up and use of microphones and the digital processing, as described herein. Other code or programs 430 and potentially other data repositories, such as data repository 406, also reside in the memory 401, and preferably execute on one or more CPUs 403. Of note, one or more of the components in FIG. 4 may not be present in any specific implementation. For example, some embodiments embedded in other software may not provide means for user input or display.

In a typical embodiment, the SAAPS 410 includes one or more Signal Processing Algorithm units (or components, engines, tools) 411, one or more other signal processing tools 412, and a SIG Array microphone control and management unit 413. In some embodiments, the raw acoustic array data from the MEMs microphones is stored in data repository 415. In at least some embodiments, some components are provided external to the SAAPS and are available, potentially, over one or more networks 450. In some embodiments, as indicated by the dashed line, the SIG Array microphone control and management unit 413 and the raw acoustic array data 415 reside in one or more FPGAs or SOCs and not in the computer system memory 401. In such a scenario, the SIG Array microphone control and management unit 413 and the raw acoustic array data 415 may be directly connected to the computer system 400 (through, for example, a USB connection) or may be accessible over the one or more networks 450 (such accessibility over a network is not shown). In yet other embodiments, the raw acoustic array data 415 may be adjacent to or stored inside of the SIG Array microphone control and management unit 413 or may be stored inside of the memory 401 separate from the SIG Array microphone control and management unit 413.

Other and/or different modules may be implemented. In addition, the SAAPS may interact via a network 450 with application or client code 455 that, for example, uses results computed by the SAAPS 410, one or more client computing systems 460, and/or other signal processing tool providers 465, such as third party system. Also, of note, the raw acoustic array data repository 415 may be provided external to the SAAPS as well, for example in a database accessible over one or more networks 450.

In an example embodiment, components/modules of the SAAPS 410 are implemented using standard programming techniques. For example, the SAAPS 410 may be implemented as a "native" executable running on the CPU 103, along with one or more static or dynamic libraries. In other embodiments, the SAAPS 410 may be implemented as instructions processed by a virtual machine, by a FPGA or SOCs. A range of programming languages known in the art may be employed for implementing such example embodiments, including representative implementations of various programming language paradigms, including but not limited to, object-oriented, functional, procedural, scripting, declarative, and others.

The embodiments described above may also use synchronous or asynchronous client-server computing techniques. Also, the various components may be implemented using more monolithic programming techniques, for example, as an executable running on a single CPU computer system, or alternatively decomposed using a variety of structuring techniques known in the art, including but not limited to, multiprogramming, multithreading, client-server, or peer-to-peer, running on one or more computer systems each having one or more CPUs. Some embodiments may execute concurrently and asynchronously and communicate using message passing techniques. Equivalent synchronous embodiments are also supported.

In addition, programming interfaces to the data stored as part of the SAAPS 410 (e.g., in the data repositories 415) can be available by standard mechanisms such as through APIs; libraries for accessing files, databases, or other data repositories; through scripting languages such as XML; or through Web servers, FTP servers, or other types of servers providing access to stored data. The 415 may be implemented as one or more database systems, file systems, or any other technique for storing such information, or any combination of the above, including implementations using distributed computing techniques.

Also the example SAAPS 410 may be implemented in a distributed environment comprising multiple, even heterogeneous, computer systems and networks. Different configurations and locations of programs and data are contemplated for use with techniques of described herein. In addition, the computing systems may be physical or virtual computing systems and may reside on the same physical system. Also, one or more of the modules may themselves be distributed, pooled or otherwise grouped, such as for load balancing, reliability or security reasons. A variety of distributed computing techniques are appropriate for implementing the components of the illustrated embodiments in a distributed manner including but not limited to TCP/IP sockets, RPC, RMI, HTTP, Web Services (XML-RPC, JAX-RPC, SOAP, etc.) and the like. Other variations are possible. Also, other functionality could be provided by each component/module, or existing functionality could be distributed amongst the components/modules in different ways, yet still achieve the functions of SAAPS.

Furthermore, in some embodiments, some or all of the components of the SAAPS 410 may be implemented or provided in other manners, such as at least partially in firmware and/or hardware, including, but not limited to one or more application-specific integrated circuits (ASICs), standard integrated circuits, controllers executing appropriate instructions, and including microcontrollers and/or embedded controllers, field-programmable gate arrays (FPGAs), complex programmable logic devices (CPLDs), SOCs, and the like. Some or all of the system components and/or data structures may also be stored as contents (e.g., as executable or other machine-readable software instructions or structured data) on a computer-readable medium (e.g., a hard disk; memory; network; other computer-readable medium; or other portable media article to be read by an appropriate drive or via an appropriate connection, such as a DVD or flash memory device) to enable the computer-readable medium to execute or otherwise use or provide the contents to perform at least some of the described techniques. Some or all of the components and/or data structures may be stored on tangible, non-transitory storage mediums. Such computer program products may also take other forms in other embodiments. Accordingly, embodiments of this disclosure may be practiced with other computer system configurations.

All of the above U.S. patents, U.S. patent application publications, U.S. patent applications, foreign patents, foreign patent applications and non-patent publications referred to in this specification and/or listed in the Application Data Sheet, including but not limited to U.S. Provisional Patent Application No. 61/896,407, entitled "DIGITAL SIGNAL PROCESSING WITH ACOUSTIC ARRAYS," filed Oct. 28, 2013, is incorporated herein by reference, in its entirety.

From the foregoing it will be appreciated that, although specific embodiments have been described herein for purposes of illustration, various modifications may be made without deviating from the spirit and scope of the invention. Also, the methods and systems discussed herein are applicable to differing protocols, communication media (optical, wireless, cable, etc.) and devices (such as wireless handsets, electronic organizers, personal digital assistants, portable email machines, game machines, pagers, navigation devices such as GPS receivers, etc.).

Also, although certain terms are used primarily herein, other terms could be used interchangeably to yield equivalent embodiments and examples. In addition, terms may have alternate spellings which may or may not be explicitly mentioned, and all such variations of terms are intended to be included.

The invention claimed is:

1. An acoustic array comprising:

a plurality of digital microphones; and one or more field programmable gate arrays (FPGAs) and/or systems-on-chip (SOCs) configured to perform digital signal processing on raw acoustic array sound pressure level measurements to produce derived acoustic array measurements that estimate sound pressure levels from an external source, and to reconstruct sound that comes from an external source, using sound pressure level measurements from two or more of the plurality of digital microphones.

2. The acoustic array of claim 1 wherein the digital microphones use microelectromechanical systems (MEMS) technology.

3. The acoustic array of claim 2 wherein the MEMS microphones use standard serial protocols.

4. The acoustic array of claim 1 wherein the plurality of digital microphones comprise at least 40 microphones.

5. The acoustic array of claim 1 wherein each microphone is located a different distance from an object and wherein the acoustic array is configured to locate one or more different sources of sound on the object.

6. The acoustic array of claim 1 wherein each microphone is located a different distance from an object and wherein the acoustic array is configured to locate a plurality of different directions of sound relative to the object.

7. The acoustic array of claim 6 wherein the derived acoustic array measurements are estimated sound pressure levels from a number of different directions.

8. The acoustic array of claim 7 wherein the estimated sound pressure levels are represented as images and/or superimposed on optical camera images.

9. The acoustic array of claim 1, wherein the output from the plurality of digital microphones is serialized and is configured to produce different effects.

10. The acoustic array of claim 1 wherein at least some of the plurality of microphones are configurable to designate a subset of the microphones for use with a particular application.

11. The acoustic array of claim 1 wherein at least some of the plurality of microphones are configurable to designate a subset of the microphones to measure a designated frequency or range of frequencies.

12. The acoustic array of claim 1 wherein each of the plurality of microphones is mounted to a small printed circuit board and then each of the small printed circuit boards are mounted to a larger printed circuit board.

13. The acoustic array of claim 12 where the mounting comprises soldering.

14. The acoustic array of claim 12 wherein the small printed circuit boards are thin printed circuit boards and are attached to a rigid plate to minimize acoustic resonance.

15. The acoustic array of claim 1, further comprising:

performing additional signal processing or computations on general purpose computing devices and integrating the results of the additional signal processing or computations with the digital signal processing performed by the one or more FPGAs and SOCs to produce the derived acoustic array measurements.

16. The acoustic array of claim 1, further comprising an external dynamic random access memory (DRAM).

17. The acoustic array of claim 16 wherein the microphone data are arranged into blocks by first arranging the microphone data into small blocks in random access memory in an FPGA or in an SOC and then arranging some or all of the small blocks of microphone data into larger blocks in the external DRAM of a size required by a signal processing algorithm.

18. The acoustic array of claim 17 wherein the signal processing algorithm is a Fast Fourier Transform (FFT).

19. A method for processing microphone data retrieved from an acoustic array having a plurality of MEMs microphones and a field programmable gate array (FPGA) and/or a systems-on-chip (SOC), comprising:

retrieving blocks of data from the plurality of MEMs microphones, the data reflective of estimated sound pressure levels from a number of different directions;

determining a size requirement for digital signal processing logic for processing the retrieved blocks of data;

storing into random access memory in the FPGA or the SOC, the blocks of data retrieved from the plurality of MEMs microphones, the stored data arranged into blocks the same block size or a different block size as the blocks of data retrieved from the plurality of MEMs microphones;

retrieving, from the random access memory, some or all of the stored data arranged into blocks and storing the data retrieved from the random access memory into a DRAM, external to the acoustic array, arranged as blocks that are larger in size than the blocks of data stored in the random access memory yet smaller in size than the determined size requirement; and forwarding one or more indicators of the blocks of data stored into the DRAM to the digital signal processing logic to yield derived sound data that locates a plurality of different directions of sound relative to the object.

20. The method of claim 19 wherein the derived sound data is represented as images and/or superimposed on optical camera images.

* * * * *